United States Patent [19]

Lee et al.

[11] 4,291,873

[45] Sep. 29, 1981

[54] EXERCISE DEVICE

[76] Inventors: Jin W. Lee, 249-1, Dongbinggo-dong, Yongsan-ku, Seoul; Jin S. Kim, 27-49, Sujin-dong, Songnam-shi, Kyongki-do, both of D.P.R. of Korea

[21] Appl. No.: 87,588

[22] Filed: Oct. 23, 1979

[30] Foreign Application Priority Data

Dec. 22, 1978 [KP] D.P.R. of Korea ..... 78-6449[U]
Jan. 12, 1979 [KP] D.P.R. of Korea ..... 79-119[U]
Jan. 12, 1979 [KP] D.P.R. of Korea ..... 79-120[U]

[51] Int. Cl.[3] ..... A63B 23/04; A63G 1/12

[52] U.S. Cl. ..... 272/146

[58] Field of Search ..... 272/50, 93, 109, 111, 272/146, 33 R, 97; 280/205; 128/25 R, 25 B

[56] References Cited

U.S. PATENT DOCUMENTS 2,206,902 7/1940 Kost ..... 128/25 B
2,920,889 1/1960 Keeling ..... 272/50 X
3,063,714 11/1962 Krauss ..... 272/146
3,441,271 4/1969 Palacios ..... 272/146 X
3,454,273 7/1969 Vogt ..... 272/146
3,593,994 7/1971 Anbar ..... 272/146
3,612,519 10/1971 Larson ..... 272/146

FOREIGN PATENT DOCUMENTS 2116221 11/1971 Fed. Rep. of Germany ..... 272/146

*Primary Examiner*—Richard J. Apley
*Attorney, Agent, or Firm*—Wenderoth, Lind & Ponack

[57] ABSTRACT

An exercise device includes a base plate, a turning disc mounted above the base plate for rotary and orbital movement with respect thereto, and bearings interposed between the base plate and turning disc. A cover is attached to the turning disc and is adapted to support the weight of a user who imparts rotary and orbital movement to the cover and thereby to the turning disc. The turning disc has therethrough a central opening. A device is supported by the base plate and cooperates with the edge of the opening in the turning disc to limit the range of orbital movement of the turning disc with respect to the base plate. An adjusting device is associated with the limiting device for selectively adjusting the range of the orbital movement of the turning disc.

12 Claims, 5 Drawing Figures

EXERCISE DEVICE

BACKGROUND OF THE INVENTION

The present invention is directed to an exercise device for aiding a user in performing calisthentics.

Modern man to a large degree is overweight, primarily due to a lack of exercise. Such overweight is particularly prevalent around the waist. Since human beings stand, the waist area normally receives the pressure of such extra weight. When a person undergoes rigorous exercise, or when a person undergoes a shock to the waist area, the person may be seriously injured in the area of the waist.

SUMMARY OF THE INVENTION

It is accordingly the primary object of the present invention to provide an exercise device which may be used for calisthentics and which is particularly useful in losing weight around the abdomen, waist and buttocks.

It is a further object of the present invention to provide such an exercise device which may easily be employed at any time and which takes up only a very small space.

These objects are achieved by the provision of an exercise device including a base plate, a turning disc mounted above the base plate for rotary and orbital movement with respect to the base plate, with bearings being interposed between the base plate and the turning disc. The turning disc includes a cover for supporting the weight of the user who imparts rotary and orbital movement to the turning disc. The turning disc has therethrough a central opening. Means are supported by the base plate for cooperation with the edge of the opening in the turning disc to limit the range of orbital movement of the turning disc with respect to the base plate. Further, an adjusting device is associated with the limiting device for adjusting the range of the orbital movement of the turning disc.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
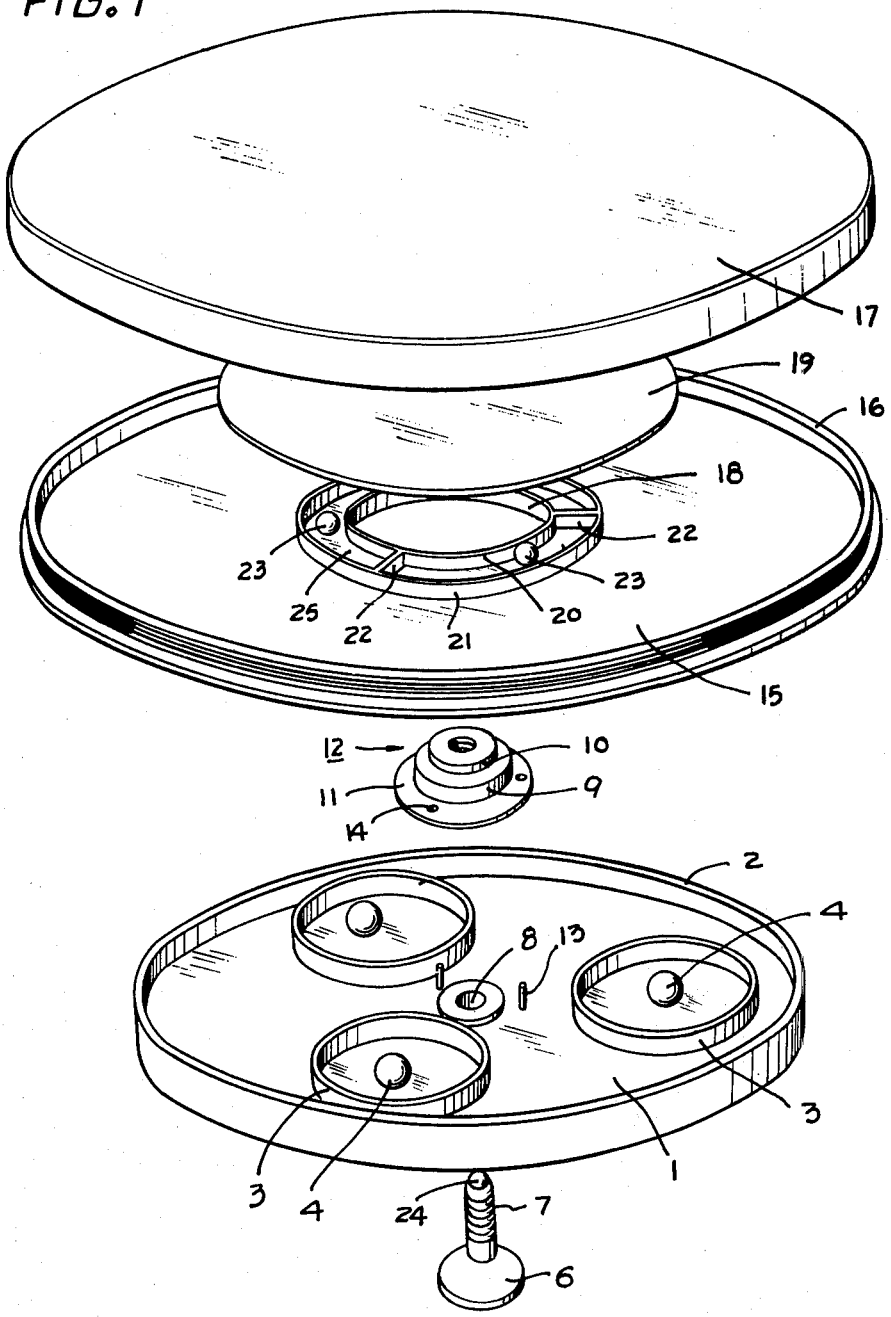
FIG. 1 is an exploded perspective view of the exercise device of the present invention.

As shown in the drawings, the exercise device of the present invention includes a base plate 1 adapted to be stationarily positioned in a suitable location. The base plate 1 is shown as being circular in configuration, but could have other configurations. The base plate has extending upwardly from its outer circumference a rim 2. Furthermore extending upwardly from the base plate 1 are a plurality of circular walls 3 which define with the base plate 1 chambers for receiving bearings, for example ball bearings 4, preferably steel ball bearings. The height, or diameter, of ball bearings 4 is greater than the height of walls 3, as particularly shown in FIG. 2. Ball bearings 4 are thus freely movable within the confines of the respective chambers defined by respective walls 3.

Mounted above the base plate 1 is a turning disc 15. Turning disc 15 is mounted for rotary and orbital movement with respect to base plate 1, in a manner which will become more apparent from the following description. Turning disc 15 rests on ball bearings 4.

The outer periphery of turning disc 15 includes an upwardly extending rim 16 which is threaded as shown. A cover 17 has a downwardly projecting rim which is similarly threaded as shown, the cover 17 being attached to turning disc 15 by means of the respective threads. Cover 17 supports the weight of a user who imparts rotary movement to the turning disc, via cover 17, with respect to the base plate 1.

The turning disc 15 has centrally therethrough an opening 18.

Extending through the central bottom portion of base plate 1 is a control bolt 7 which includes an enlarged head 6 which abuts against and is received within a recess 5 in the bottom of base plate 1. Control bolt 7 further includes a threaded stem which extends through a central hole 8 in base plate 1 and which extends upwardly above base plate 1.

Threaded onto the threaded stem of the control bolt 7 is an annular control member 12 which includes a plurality of axially spaced portions providing cam surfaces having differing diameters. In the illustrated embodiment there are provided two such cam surfaces, i.e. relatively smaller cam surface 10 and relatively larger cam surface 9. The control member 12 also includes a lower outwardly extending flange 11 having holes 14 therethrough. Guide posts 13 extend integrally upwardly from base plate 1 and extend through holes 14. Therefore, it will be apparent that rotation of the control bolt 7 will cause relative axial movement of control member 12 with respect to control bolt 7. The holes 14 and guide posts 13 will allow such axial movement but will prevent rotation of control member 12 upon rotation of control bolt 7.

Positioned above turning disc 15 is a connecting plate 19 which is fixedly connected to the upper end of the threaded stem of control bolt 7. Positioned concentrically surrounding the opening 18 in turning disc 15 are plural annular rims 20 and 21 which are joined by plural rims, for example radial rims 22, to define a plurality of chambers 25. Bearings, for example ball bearings 23, are positioned within chambers 25 and have heights, i.e. diameters, greater than the height of rims 20 and 21. Connecting plate 19 rests on ball bearings 23. It will be apparent that the above assembly enables connecting plate 19 and control bolt 7 to effectively connect base plate 1 and turning disc 15 to each other. It will specifically be apparent that rotation of control bolt 7 will result in similar rotation of connecting plate 19.

A ball bearing 24 is positioned between the upper end of the threaded stem of control bolt 7 and the bottom surface of cover 17. Thus, control bolt 7 and ball bearing 24 provide a central support for cover 17. Since cover 17 is to bear the weight of a user, it preferably should be formed of solid and tough material. Also preferably, the cover 17 has on the undersurface thereof a layer or plating 26 of hard material, for example hard steel.

Although it is believed that the operation of the exercise device of the present invention will be apparent from the above discussion, such operation will now be briefly described.

Figure 2:
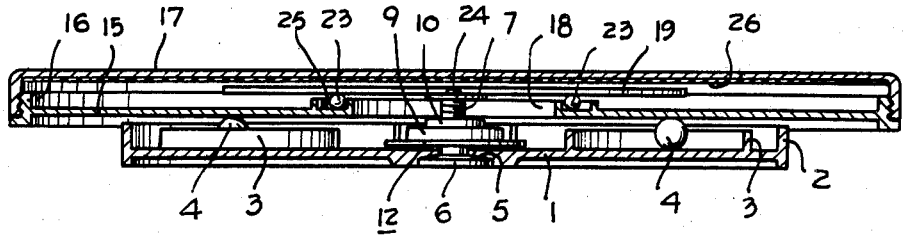
FIG. 2 is a cross-sectional view of the exercise device of the present invention.
Figure 3:
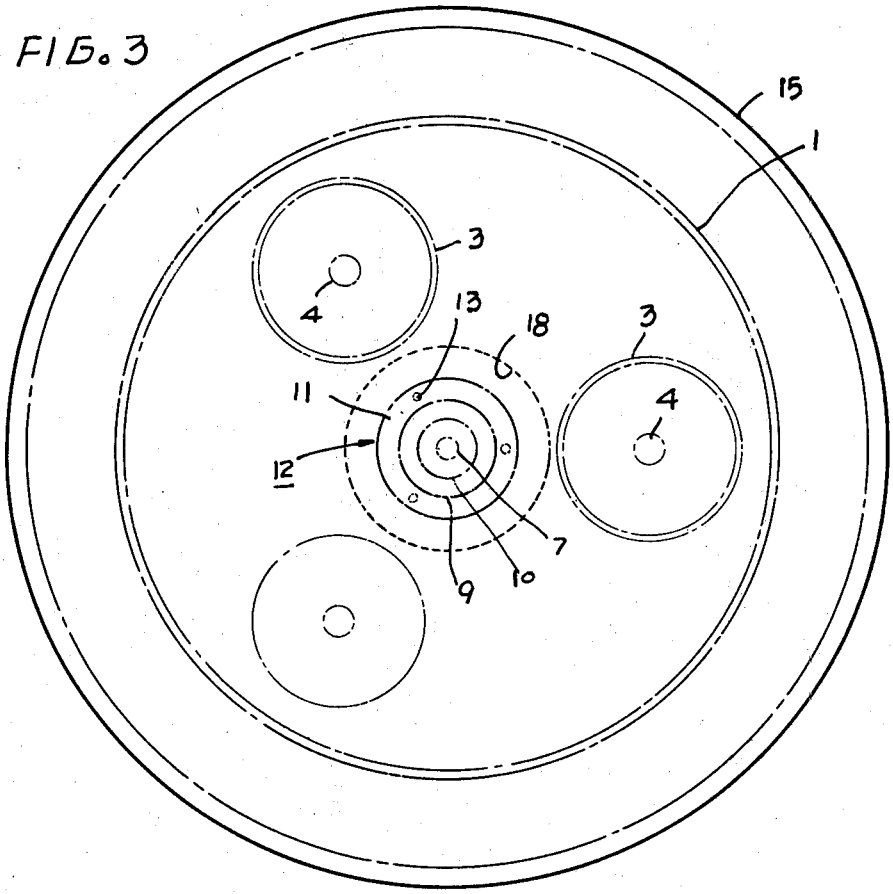
FIG. 3 is a plan view of the exercise device of the present invention, with various constructional features thereof being represented.
Figure 5:
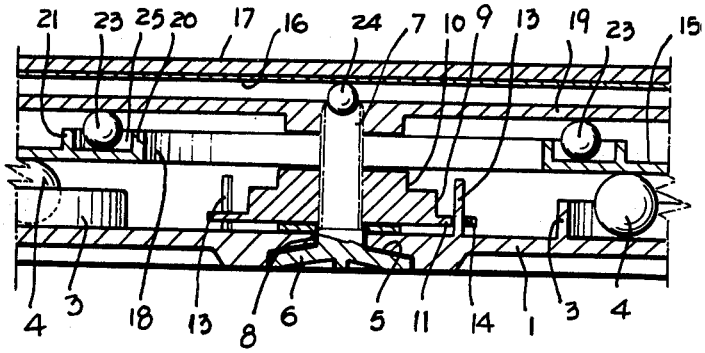
FIG. 5 is a partial enlarged sectional view of the exercise device of the present invention.
Figure 4:
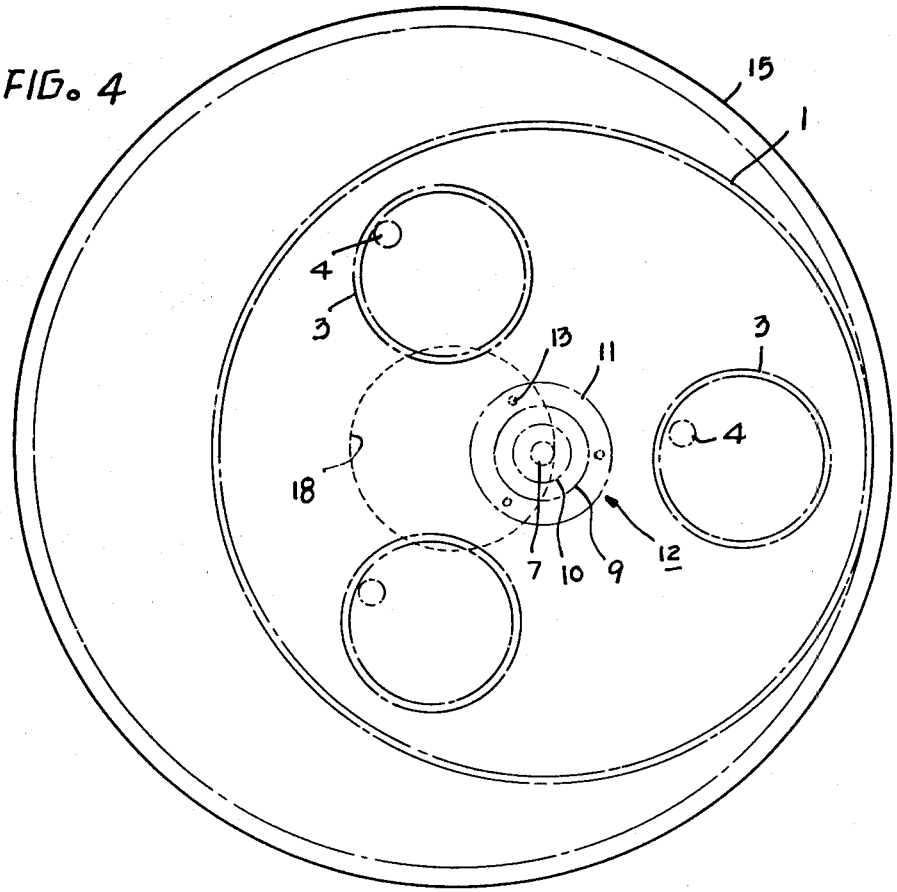
FIG. 4 is a view similar to FIG. 3 but showing the device having undergone orbital movement.

With the device in the position shown in FIGS. 2, 3 and 5, a user sits a portion of his body, for example the buttocks, on cover 17 and thereby imparts a rotary motion thereto. Such rotary motion is transferred to turning disc 15, such that turning disc 15 not only rotates with respect to base plate 1 but also travels through an orbital path. Cover 17 is pressed against ball bearing 24, connecting plate 19 is supported by ball bearings 23, and turning disc 15 is supported by ball bearings 4. All of these ball bearings enable relatively frictionless movement between the respective elements, particularly between turning disc 15 and base plate 1. In the position shown in FIGS. 2 and 5 of the drawings, the edge of opening 18 is laterally and transversely adjacent a length portion of the threaded stem of control bolt 7. Thus, during rotary and orbital movement of turning disc 15 with respect to base plate 1, the edge of opening 18 will abut against this length portion of control bolt 7, thereby limiting the range of such orbital movement. This is clearly illustrated in FIG. 4 of the drawings wherein the edge of opening 18 is shown as abutting with a length portion of the threaded stem of control bolt 7.

When it is desired to alter the range of orbital movement of the turning disc 15, then control bolt 7 is rotated, thereby causing control member 12 to move axially upwardly with respect to control bolt 7. When sufficient such axial movement has been made such that cam surface 10 is laterally adjacent the edge of opening 18, then cam surface 10 will limit the range of orbital movement of the turning disc 15. The range of this orbital movement will be less than that when limited by the length portion of control bolt 7.

Even further, when it is additionally desired to limit the range of orbital movement of the turning disc 15, the control bolt 7 is additionally rotated, thereby causing further upward axial movement of control member 12 with respect to control bolt 7, until cam surface 9 is laterally adjacent the edge of opening 18. Cam surface 9 will then limit the range of the orbital movement of the turning disc 15, and such range of orbital movement will be less than that described above when limited by cam surface 10.

It will be apparent that the control member 12 could have further additional sized and shaped cam surfaces to even further limit the range of the orbital movement of the turning disc 15 with respect to the base plate 1.

Although the present invention has been described and illustrated with regard to a preferred embodiment thereof, it will be apparent that various modifications may be made without departing from the scope of the present invention.

What we claim is:

1. An exercise device comprising:

a base plate;

a turning disc mounted above said base plate for rotary and orbital movement with respect to said base plate;

bearing means interposed between said base plate and said turning disc;

said turning disc having therethrough a central opening;

means supported by said base plate for cooperation with the edge of said opening in said turning disc for limiting the range of said orbital movement of said turning disc with respect to said base plate;

means associated with said limiting means for selectively adjusting the range of said orbital movement of said turning disc; and said turning disc further including means for supporting the weight of the user who imparts a force to said weight supporting means which reacts with said orbital movement limiting means and said bearing means to impart a rotary and orbital movement to said turning disc relative to said base plate.

2. A device as claimed in claim 1, wherein said base plate has extending upwardly therefrom a plurality of walls forming enclosed chambers, said bearing means including bearings being positioned in said chambers in contact with said base plate and a bottom surface of said turning disc, and said bearings having a height greater than the height of said walls.

3. A device as claimed in claim 1, wherein said weight supporting means comprises a cover plate joined at the periphery thereof to the periphery of said turning disc.

4. A device as claimed in claim 1, further comprising means cooperating with said adjusting means for axially connecting said turning disc to said base plate while allowing said rotary and orbital movement.

5. A device as claimed in claim 4, wherein said connecting means comprises a connecting plate positioned above said turning disc and fixed to said adjusting means, and a second bearing means interposed between said turning disc and said connecting plate.

6. A device as claimed in claim 5, further comprising first and second rims extending upwardly from said turning disc at positions concentrically surrounding said opening, and plural radial rims extending between said first and second annular rims, thereby forming plural chambers, said second bearing means being positioned in said chambers.

7. A device as claimed in claim 5, wherein said adjusting means comprises a control bolt including a head abutting a bottom surface of said base plate and a threaded stem extending through and upwardly from said base plate, said connecting plate being fixed to an upper end of said stem of said control bolt.

8. A device as claimed in claim 7, further comprising a ball bearing interposed between said upper end of said stem of said control bolt and said weight supporting means.

9. A device as claimed in claim 8, wherein said weight supporting means comprises a cover fixed to said turning disc and having a lower surface of hardened material in contact with said ball bearing.

10. A device as claimed in claim 7, wherein said limiting means comprises a portion of the length of said stem of said control bolt, said portion being laterally spaced from said edge of said opening, whereby upon said orbital movement of said turning disc with respect to said base plate said edge abuts said portion, thereby limiting said orbital movement.

11. A device as claimed in claim 10, wherein said limiting means further comprises an annular control member threaded onto said stem of said control bolt, said control member having plural axially spaced cam surfaces of differing diameters, whereby manual rotation of said control bolt will cause axial displacement of said control member along said stem, thereby laterally aligning a selected said cam surface with said edge of said opening in said turning disc, whereby upon said orbital movement of said turning disc with respect to said base plate said edge abuts said selected cam surface, thereby limiting said orbital movement.

12. A device as claimed in claim 11, wherein said control member further includes a radially outwardly extending flange having therethrough at least one hole, and further comprising at least one guide post fixed to and extending upwardly from said base plate, said guide post extending through said hole, whereby upon manual rotation of said control bolt said guide post prevents rotation of said control member but allows axial movement thereof with respect to said control bolt.

* * * * *